US008862029B2

(12) United States Patent
Shimizu et al.

(10) Patent No.: US 8,862,029 B2
(45) Date of Patent: Oct. 14, 2014

(54) IMAGE FORMING APPARATUS

(75) Inventors: Tamotsu Shimizu, Osaka (JP); Takahisa Nakaue, Osaka (JP); Takashi Morita, Osaka (JP); Teruhiko Nagashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 184 days.

(21) Appl. No.: 13/443,973

(22) Filed: Apr. 11, 2012

(65) Prior Publication Data

US 2012/0263495 A1 Oct. 18, 2012

(30) Foreign Application Priority Data

Apr. 14, 2011 (JP) ..... 2011-090314

(51) Int. Cl.
*G03G 15/08* (2006.01)
*G03G 21/16* (2006.01)

(52) U.S. Cl.
CPC ..... *G03G 15/0896* (2013.01); *G03G 21/1676* (2013.01); *G03G 21/1633* (2013.01)
USPC ..... 399/119; 399/263

(58) Field of Classification Search
CPC ..... G03G 21/1853; G03G 21/16; G03G 2221/169; G03G 21/185; G03G 15/0875; G03G 21/1676; G03G 2215/0668
USPC ..... 399/119, 124, 125, 263
See application file for complete search history.

(56) References Cited

U.S. PATENT DOCUMENTS

| | | | | |
|---|---|---|---|---|
| 5,166,732 | A | 11/1992 | Fuji | |
| 8,385,772 | B2 * | 2/2013 | Yoon et al. | 399/103 |
| 2002/0041775 | A1 | 4/2002 | Ishii | |
| 2005/0002682 | A1 | 1/2005 | Lyu et al. | |
| 2005/0036810 | A1 | 2/2005 | Murakami et al. | |
| 2006/0140679 | A1 | 6/2006 | Iwata et al. | |
| 2007/0065182 | A1 * | 3/2007 | Okimura et al. | 399/258 |
| 2008/0205953 | A1 | 8/2008 | Takemoto et al. | |
| 2009/0087225 | A1 * | 4/2009 | Sakuma | 399/262 |
| 2010/0329738 | A1 | 12/2010 | Shirai | |

FOREIGN PATENT DOCUMENTS

JP 2005-31673 2/2005

* cited by examiner

*Primary Examiner* — Gregory H Curran
(74) *Attorney, Agent, or Firm* — Gerald E. Hespos; Michael J. Porco; Matthew T. Hespos

(57) ABSTRACT

An image forming apparatus includes an image bearing member for bearing a toner image, a developing device for supplying toner to a circumferential surface of the image bearing member, a toner container for supplying the toner to the developing device, a sheet conveyance path for conveying a sheet, and a housing. The housing accommodates the image bearing member, the developing device and the toner container. The housing has a first surface and a second surface different from the first surface. The toner container is taken out from the interior of the housing to the outside of the housing through the first surface. The developing device is taken out from the interior of the housing to the outside of the housing through the second surface.

5 Claims, 7 Drawing Sheets

IMAGE FORMING APPARATUS

This application is based on Japanese Patent Application Serial No. 2011-090314 filed with the Japan Patent Office on Apr. 14, 2011, the contents of which are hereby incorporated by reference.

BACKGROUND

The present disclosure relates to an image forming apparatus.

Conventionally, there is known an image forming apparatus for forming a toner image on the circumferential surface of a photoconductive drum by supplying toner prepared in advance to the circumferential surface of the photoconductive drum on which an electrostatic latent image is formed. The image forming apparatus includes a developing unit storing toner inside in advance. Since the developing unit has a service life, it needs to be regularly exchanged. Thus, in the conventional image forming apparatus, an open/close cover used to take the developing unit from the inside is provided on the front surface which a user will face.

Further, the image forming apparatus houses a waste toner container for collecting waste toner produced after a toner image on the circumferential surface of the photoconductive drum is transferred to a sheet. This waste toner container needs to be exchanged when being filled up with waste toner. Thus, in the conventional image forming apparatus, an open/close cover used to take out the waste toner container from the inside is provided on a side surface thereof.

Furthermore, an open/close cover used to exchange a drum unit including the photoconductive drum is provided on the upper surface of the image forming apparatus and an open/close cover used to expose a sheet conveyance path for conveying a sheet is provided on the rear surface thereof.

The above image forming apparatus is so configured that the developing unit, the waste toner container and the drum unit are respectively taken out through the front, side and upper surfaces and the sheet conveyance path is exposed on the rear surface. Thus, in installing the image forming apparatus, extra spaces for allowing the respective open/close covers on the front, side, upper and rear surfaces to open and close are necessary, wherefore the installation location of the image forming apparatus is limited.

Further, in a small-size image forming apparatus, a developing unit and a photoconductive drum may be assembled into a unit and the unit may be exchanged when toner in the developing unit is used up. However, parts (e.g. developing roller) of the developing unit have a relatively long service life and, if the entire developing unit is exchanged to supply toner, parts which can be further used are discarded, which is uneconomical.

Accordingly, there has been proposed an image forming apparatus in which a toner container containing toner is housed by being assembled with a developing unit and the toner container and the developing unit are separately exchanged. The following methods, for example, exist as a method for exchanging a toner container and a developing unit in an image forming apparatus of this type.

According to a first method, the toner container and the developing unit are temporarily taken out from the apparatus, either one of the toner container and the developing unit is exchanged and a new one is assembled with the other and returned into the apparatus. Since it is inevitably required to taken out the heavy developing unit from the apparatus in this method, the developing unit may be damaged due to a fall or collision. Further, when the developing unit and the toner container are separated, foreign matters such as dust may enter through a toner supply opening used to supply toner into the developing unit.

According to a second method, the toner container is taken out from the apparatus earlier than the developing unit. This method is inconvenient since the developing unit cannot be taken out earlier than the toner container. There is also a method by which a toner conveyance path is provided between the developing unit and the toner container and the toner container is taken out from the toner conveyance path, but the image forming apparatus is enlarged since the toner conveyance path is provided extra.

To solve the above problems, an object of the present disclosure is to provide an image forming apparatus enabling a developing unit and a toner container to be easily exchanged while realizing space saving.

SUMMARY

An image forming apparatus according to one aspect of the present disclosure includes an image bearing member, a developing device, a toner container, a sheet conveyance path for conveying a sheet and a housing. The image bearing member bears a toner image on its circumferential surface. The developing device includes a developing roller for supplying toner to the circumferential surface of the image bearing member. The toner container is assembled with the developing device to supply the toner to the developing device. The housing accommodates the image bearing member, the developing device and the toner container. The housing has a first surface and a second surface different from the first surface. The toner container is taken out from the interior of the housing to the outside of the housing through the first surface. The developing device is taken out from the interior of the housing to the outside of the housing through the second surface.

These and other objects, features and advantages of the present disclosure will become more apparent upon reading the following detailed description along with the accompanying drawings.

DETAILED DESCRIPTION

Figure 1:
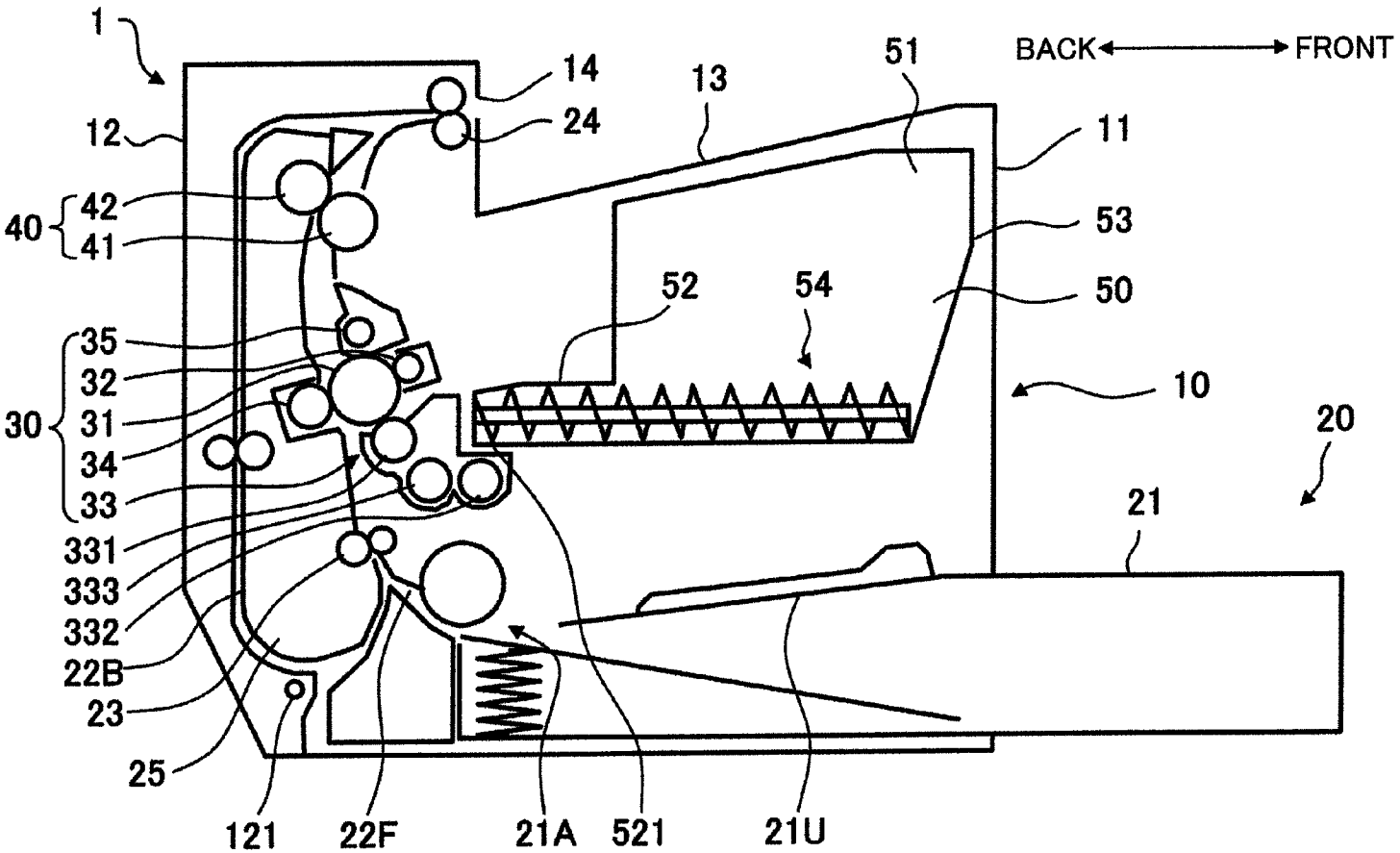
FIG. 1 is a sectional view showing the internal structure of an image forming apparatus according to one embodiment of the present disclosure.

Hereinafter, an embodiment of the present disclosure is described in detail based on the drawings. FIG. 1 is a sectional view showing the internal structure of an image forming apparatus 1 according to one embodiment of the present disclosure. Although a black-and-white printer is illustrated as the image forming apparatus 1 here, the image forming apparatus may be a copier, a facsimile machine or a multi functional peripheral provided with these functions or may be an image forming apparatus for forming a color image.

The image forming apparatus 1 includes a main housing 10 (housing) having a substantially rectangular parallelepipedic housing structure, a feeding unit 20, an image forming unit 30, a fixing unit 40 and a toner container 50 accommodated in the main housing 10.

The main housing 10 has the housing structure with four side surfaces including a front surface (first surface) which a user will face, a rear surface (second surface) opposite to the front surface, left and right surfaces, and bottom and upper surfaces. A front cover 11 (first cover) is provided on the front side (right side of FIG. 1) of the main housing 10, and a rear cover 12 (a part of a second cover) is provided on the rear side. The user can take out the toner container 50 from the front side of the main housing 10 when toner runs out by opening the front cover 11. The rear cover 12 is a cover which is opened at the time of a sheet jam and maintenance. The respective units such as the image forming unit 30 and the fixing unit 40 can be taken out from the rear side of the main housing 10 by opening the rear cover 12. Further, a sheet discharge portion 13 to which a sheet after image formation is to be discharged is provided on the upper surface of the main housing 10.

The feeding unit 20 includes a sheet cassette 21 for storing sheets on which an image forming operation is to be performed. This sheet cassette 21 can be withdrawn forward from the front side of the main housing 10. The sheet cassette 21 includes a sheet storage space where a stack of sheets is stored, a lift plate for lifting up the stack of sheets for sheet feeding, and the like. A sheet feeding portion 21A is provided above the rear end of the sheet cassette 21. A pickup roller (not shown) for picking up the uppermost sheet of the sheet stack in the sheet cassette 21 one by one is arranged in this sheet feeding portion 21A.

The image forming unit 30 performs an image forming process of forming a toner image on a sheet fed from the feeding unit 20. The image forming unit 30 includes a photoconductive drum 31 (image bearing member), and a charger 32, an exposure device (not shown in FIG. 1), a developing device 33, a transfer roller 34 and a cleaner 35 arranged around the photoconductive drum 31.

The photoconductive drum 31 rotates about its shaft and has an electrostatic latent image and a toner image formed on its circumference surface. A photoconductive drum made of an amorphous silicon (a-Si) material can be used as the photoconductive drum 31. The charger 32 uniformly charges the circumferential surface of the photoconductive drum 31 and includes a charging roller held in contact with the photoconductive drum 31. The exposure device includes a laser light source and optical devices such as mirrors and lenses and forms an electrostatic latent image by irradiating the circumferential surface of the photoconductive drum 31 with light modulated based on image data fed from an external apparatus such as a personal computer.

The developing device 33 supplies toner to the circumferential surface of the photoconductive drum 31 to develop the electrostatic latent image on the photoconductive drum 31 and form a toner image. The developing device 33 includes a developing roller 331 for bearing the toner to be supplied to the photoconductive drum 31 and a first and a second conveying screws 332, 333 for conveying developer (toner) in a circulating manner in a developer housing 60 (see FIGS. 2 to 5) while agitating the developer. This developing device 33 is described in detail later.

The transfer roller 34 is a roller for transferring a toner image formed on the circumferential surface of the photoconductive drum 31 to a sheet and a nip portion is formed between the transfer roller 34 and the photoconductive drum 31. A transfer bias having a polarity opposite to that of the toner is applied to this transfer roller 34. The cleaner 35 includes a cleaning roller and the like and cleans the circumferential surface of the photoconductive drum 31 after the transfer of a toner image.

The fixing unit 40 performs a fixing process of fixing a transferred toner image to a sheet. The fixing unit 40 includes a fixing roller 41 including a heat source inside and a pressure roller 42 pressed in contact with this fixing roller 41 and forming a fixing nip portion together with the fixing roller 41. When a sheet having a toner image transferred thereto passes the fixing nip portion, the toner image is fixed to the sheet by being heated by the fixing roller 41 and pressed by the pressure roller 42.

The toner container 50 (see FIG. 6) is for storing the toner to be supplied to the developing device 33. The toner container 50 includes a container main body 51 as a main toner storage location, a cylindrical portion 52 projecting from a lower part of one side surface (rear surface in FIG. 1) of the container main body 51, a lid member 53 for covering another side surface of the container main body 51 and a rotating member 54 housed in the container to convey the toner. The rotating member 54 is driven and rotated, thereby the toner stored in the toner container 50 is supplied into the developing device 33 through a toner discharge opening 521 provided on the lower surface of the leading end of the cylindrical portion 52. Note that the toner discharge opening 521 is constantly closed by a container shutter 523 biased by an unillustrated spring member. The container shutter 523 interferes with a part of the developing device 33 and moves to open the toner discharge opening 521 when being assembled with the developing device 33.

A main conveyance path 22F (sheet conveyance path), a reversing conveyance path 22B and a reversing unit 25 (a part of the second cover) provided with conveyance guide surfaces for forming these conveyance paths 22F, 22B are provided in the main housing 10 to convey a sheet. The main conveyance path 22F extends from the sheet feeding portion 21A of the feeding unit 20 to a sheet discharge port 14 provided to face the sheet discharge unit 13 on the upper surface of the main housing 10 via the image forming unit 30 and the fixing unit 40. The reversing conveyance path 22B is a conveyance path for returning a sheet having one side printed to a side of the main conveyance path 22F upstream of the image forming unit 30 in the case of printing both sides of the sheet.

A pair of registration rollers 23 are arranged at a position of the main conveyance path 22F upstream of the transfer nip portion between the photoconductive drum 31 and the transfer roller 34. A sheet is temporarily stopped by the pair of registration rollers 23 and fed to the transfer nip portion at a predetermined timing for image transfer after a skew correction. A plurality of conveyor rollers for conveying a sheet are arranged at suitable positions of the main conveyance path 22F and the reversing conveyance path 22B. For example, a pair of discharge rollers 24 are arranged near the sheet discharge port 14.

The reversing conveyance path 22B is formed between an outer side surface of the reversing unit 25 and the inner surface of the rear cover 12 of the main housing 10. That is, the outer side surface of the reversing unit 25 is used as one of conveyance guide surfaces of the reversing conveyance path 22B. The other conveyance guide surface of the reversing conveyance path 22B is the inner surface of the rear cover 12. On the other hand, an inner side surface of the reversing unit 25 is used as one of the conveyance guide surfaces of the main conveyance path 22F. The other conveyance guide surface of the main conveyance path 22F is a conveyance guide surface provided in the main housing 10.

The transfer roller 34 and one of the pair of registration rollers 23 are mounted on the reversing unit 25. The rear cover 12 is rotatable about an axis of a supporting point portion 121 provided at the lower end thereof. Further, the reversing unit 25 is rotatable about an axis of a supporting point portion 250 (see FIG. 7) provided at the lower end thereof. If a sheet jam occurs in the reversing conveyance path 22B, the rear cover 12 is opened for clearing the sheet jam. For clearing a sheet jam occurred in the main conveyance path 22F or taking out a unit including the photoconductive drum 31 or the developing device 33, the reversing unit 25 is opened in addition to the rear cover 12.

Figure 2:
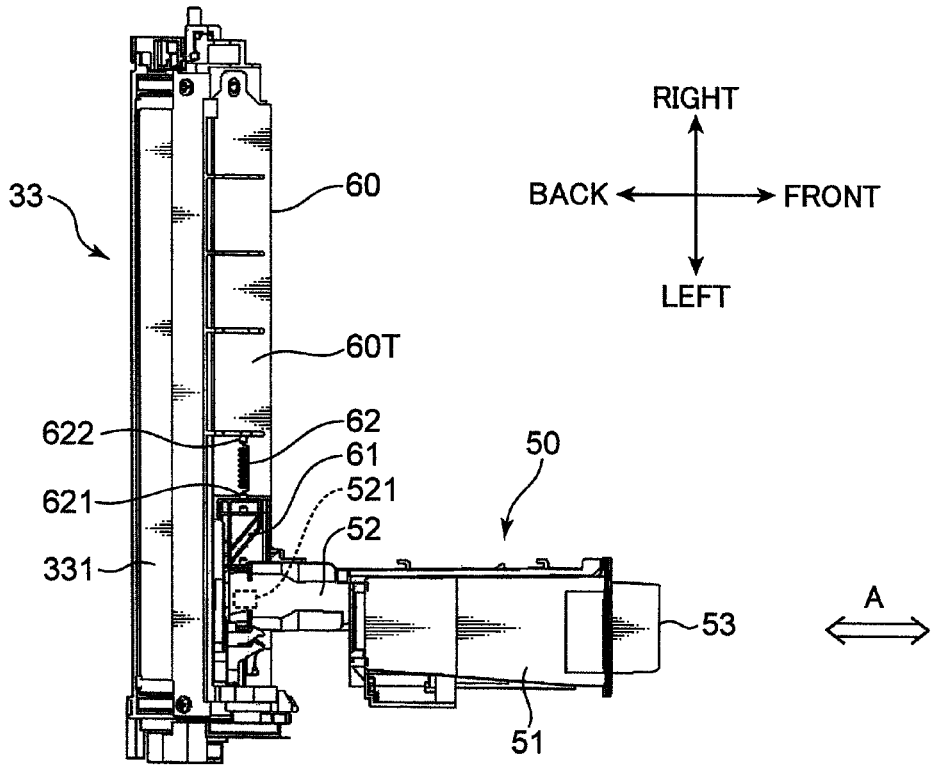
FIG. 2 is a plan view showing an assembled state of a developing device and a toner container.
Figure 3:
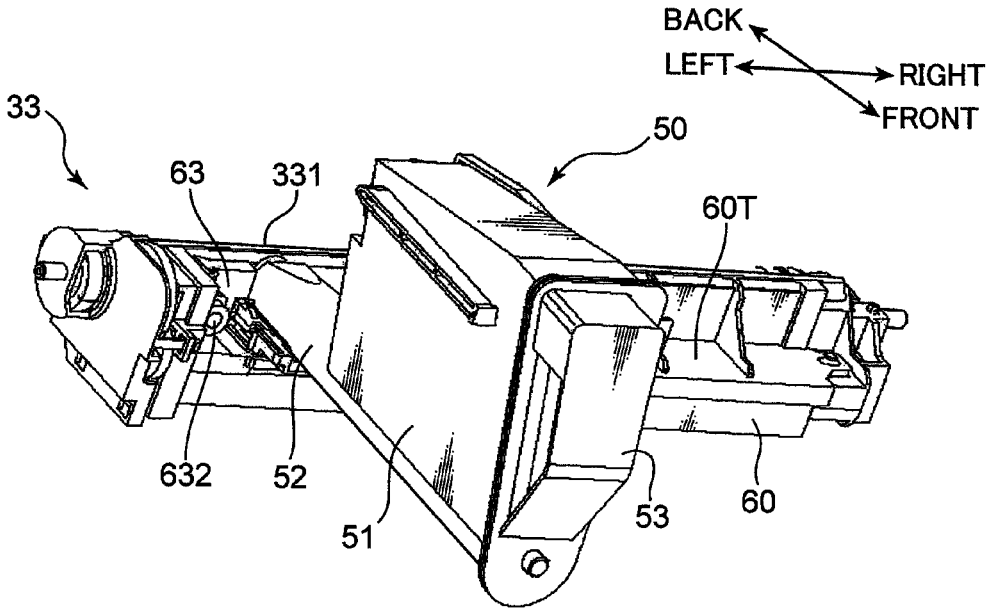
FIG. 3 is a perspective view showing the assembled state of the developing device and the toner container.
Figure 4:
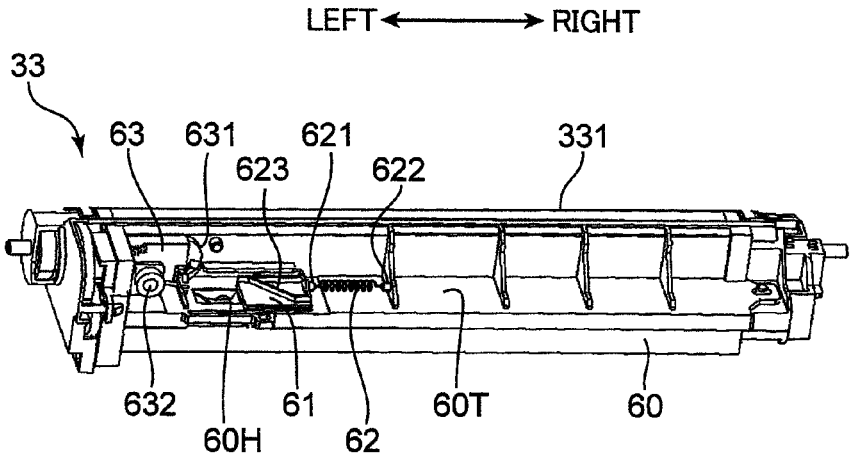
FIG. 4 is a perspective view of the developing device alone.
Figure 5:
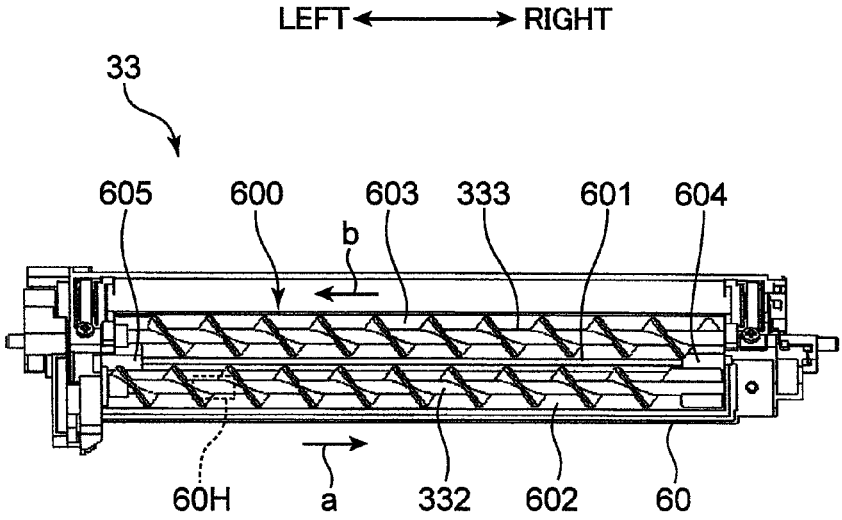
FIG. 5 is a plan view showing the internal structure of the developing device.
Figure 6:
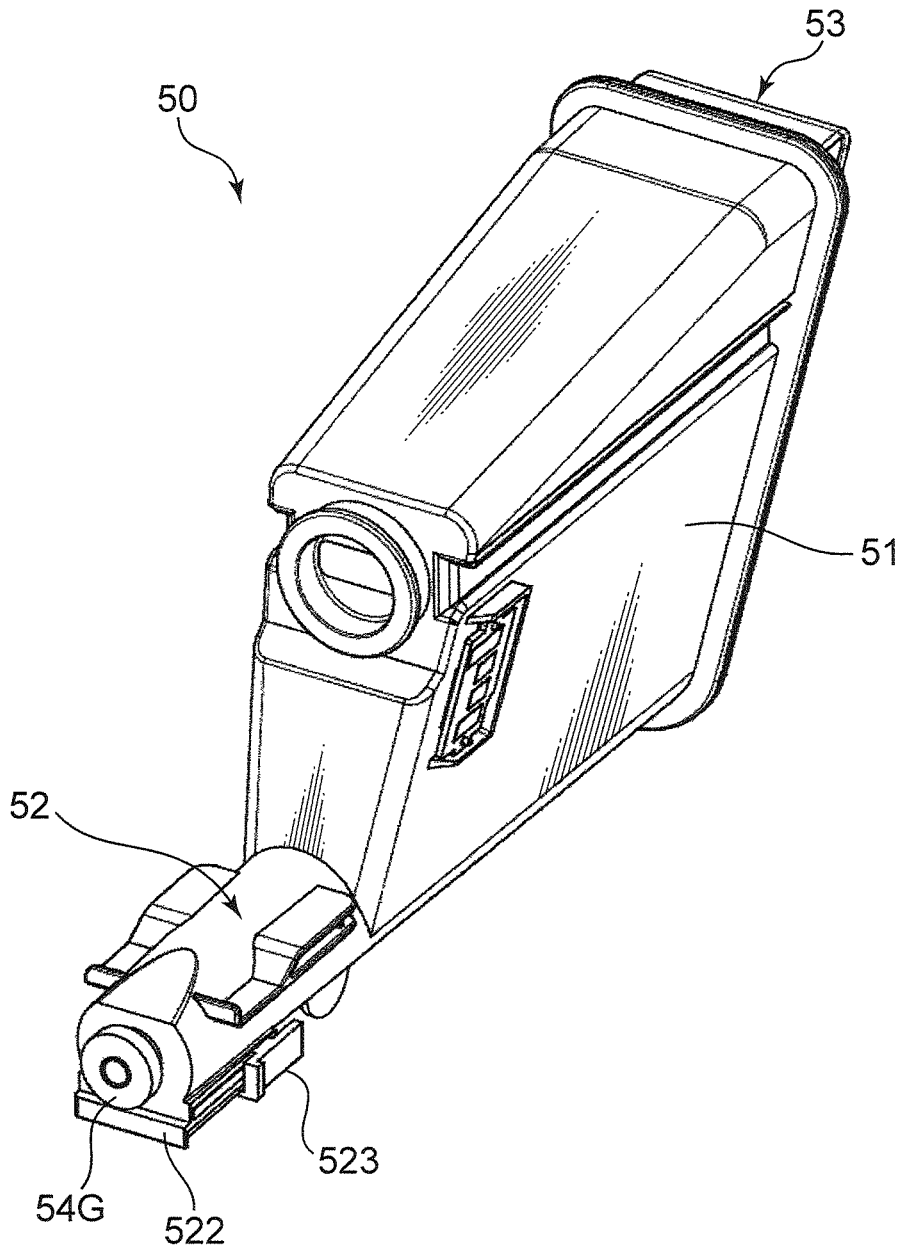
FIG. 6 is a perspective view of the toner container alone.

Next, the structures and relative arrangement of the developing device 33 and the toner container 50 are described with reference to FIGS. 2 to 6. FIG. 2 is a plan view showing an assembled state of the developing device 33 and the toner container 50, FIG. 3 is a perspective view showing the state of FIG. 2, FIG. 4 is a perspective view of the developing device 33 alone, FIG. 5 is a plan view showing the internal structure of the developing device 33 and FIG. 6 is a perspective view of the toner container 50 alone.

The developing device 33 includes the developer housing 60 having a box shape long in one direction (axial direction of the developing roller 331). The developer housing 60 includes an opening extending in a longitudinal direction thereof, and a part of the circumferential surface of the developing roller 331 is exposed through this opening. In this embodiment, the developer housing 60 is so assembled into the main housing 10 that the longitudinal direction thereof is aligned with a lateral direction (first direction) of the main housing 10.

A ceiling plate 60T near the left end of the developer housing 60 is perforated with a toner supply opening 60H used to receive the toner supplied from the toner container 50 into this housing 60. The developing device 33 and the toner container 50 are so assembled that this toner supply opening 60H and the toner discharge opening 521 of the toner container 50 overlap in a vertical direction. The toner container 50 is mounted to and removed from the developing device 33 in directions perpendicular to the longitudinal direction of the developer housing 60 (forward and backward directions/second direction) as shown by arrows A in FIG. 2. Since the toner container 50 has a housing shape long in one direction when viewed from above, a substantially L-shaped structure when viewed from above is formed with the toner container 50 mounted to the developing device 33 (see FIG. 2).

A developer shutter plate 61 slidable in the lateral direction is arranged on the upper surface of the ceiling plate 60T. The developer shutter plate 61 is constantly biased leftward by a biasing spring 62. The biasing spring 62 is a coil spring and the respective ends thereof are mounted on spring seats 621, 622 provided on the right end edge of the developer shutter plate 61 and a rib adjacent to the developer shutter plate 61. Although an open state of the toner supply opening 60H is shown in FIG. 4, the developer shutter plate 61 is biased by the biasing spring 62 to be located on the left side and close the toner supply opening 60H in a state where the toner container 50 is not mounted yet.

A pressing plate 522 is mounted at a lower part of the leading end of the cylindrical portion 52 of the toner container 50. Further, a container gear 54G for inputting a rotational drive force to the rotating member 54 is exposed and arranged on the leading end surface of the cylindrical portion 52. A gear holder 63 provided with an input gear 631 and a coupling 632 is arranged at the left back side of the toner supply opening 60H of the developer housing 60. A rotational drive force from an unillustrated motor provided in the main housing 10 is applied to the coupling 632. The input gear 631 is engaged with the container gear 54G and transmits the rotational drive force to the container gear 54G with the toner container 50 mounted to the developing device 33.

In mounting the toner container 50 to the developing device 33, the cylindrical portion 52 of the toner container 50 is inserted into the toner supply opening 60H from the front side to the rear side. At this time, the pressing plate 522 of the toner container 50 interferes with the developer shutter plate 61 closing the toner supply opening 60H and moves this developer shutter plate 61 rightward. Specifically, the pressing plate 522 interferes with an oblique elongated projection 623 projecting on the upper surface of the developer shutter plate 61 and the developer shutter plate 61 is pressed rightward against a biasing force of the biasing spring 62. When the cylindrical portion 52 of the toner container 50 is inserted to a predetermined position, the toner supply opening 60H is completely open and the container gear 54G is engaged with the input gear 631.

At this time, the container shutter 523 also interferes with a part of the developer housing 60 to open the toner discharge opening 521. In this way, the toner supply opening 60H and the toner discharge opening 521 overlap in the vertical direction, thereby enabling toner supply from the toner container 50 to the developer housing 60. When the toner container 50 is removed from the main housing 10 or when the developing device 33 is removed from the main housing 10, the developer shutter plate 61 is released from the pressing by the pressing plate 522. This causes the developer shutter plate 61 to close the toner supply opening 60H and the container shutter 523 to close the toner discharge opening 521. Accordingly, even if the developing device or the toner container 50 is singly removed from the main housing 10, the toner does not leak in the main housing 10.

With reference to FIG. 5, the developer housing 60 includes an internal space 600. In the case of a two-component developing method, developer composed of toner and carrier is filled in this internal space 600. The carrier is agitated and mixed with the toner in the internal space 600, thereby charging the toner and conveying the toner to the developing roller 331. The toner is successively supplied to the developing roller 331 to be consumed, and the amount of the toner corresponding to the consumed amount is appropriately supplied from the toner container 50.

The internal space 600 of the developer housing 60 is partitioned into a first passage 602 and a second passage 603 long in the lateral direction by a partition plate 601 extending in the lateral direction. The partition plate 601 is shorter than the width of the developer housing 60 in the lateral direction, and a first communicating portion 604 and a second communicating portion 605 for allowing the first passage 602 and the second passage 603 to communicate are provided at the right and left ends of the partition plate 601. In this way, a circulation path composed of the first passage 602, the first communicating portion 604, the second passage 603 and the second communicating portion 605 is formed in the developer housing 60.

The above toner supply opening 60H is arranged above the vicinity of the left end of the first passage 602. The first conveying screw 332 is housed in the first passage 602, and the second conveying screw 333 is housed in the second passage 603. Each of the first and second conveying screws 332, 333 includes a shaft and a blade portion spirally projecting on the outer periphery of this shaft. The first conveying screw 332 is driven and rotated about the shaft, thereby conveying the developer in a direction of an arrow "a" of FIG. 5. On the other hand, the second conveying screw 333 is driven and rotated about the shaft, thereby conveying the developer in a direction of an arrow "b".

By driving and rotating the first and second conveying screws 332, 333, the developer is conveyed in a circulating manner along the above circulating path. Toner newly supplied through the toner supply opening 60H is described. The toner falls down to the first passage 602, is mixed with the existing developer and conveyed in the direction of the arrow "a" by the first conveying screw 332. At this time, the toner is agitated with the carrier to be charged. Subsequently, the toner reaches the second passage 603 from the downstream end of the first passage 602 via the first communicating portion 604 and is conveyed in the direction of the arrow "b" by the second conveying screw 333. During this conveyance, the toner is similarly charged and, on the other hand, a part thereof is supplied to the circumferential surface of the developing roller 331. The remaining toner and the carrier are returned to the upstream end of the first passage 602 via the second communicating portion 605.

Figure 7:
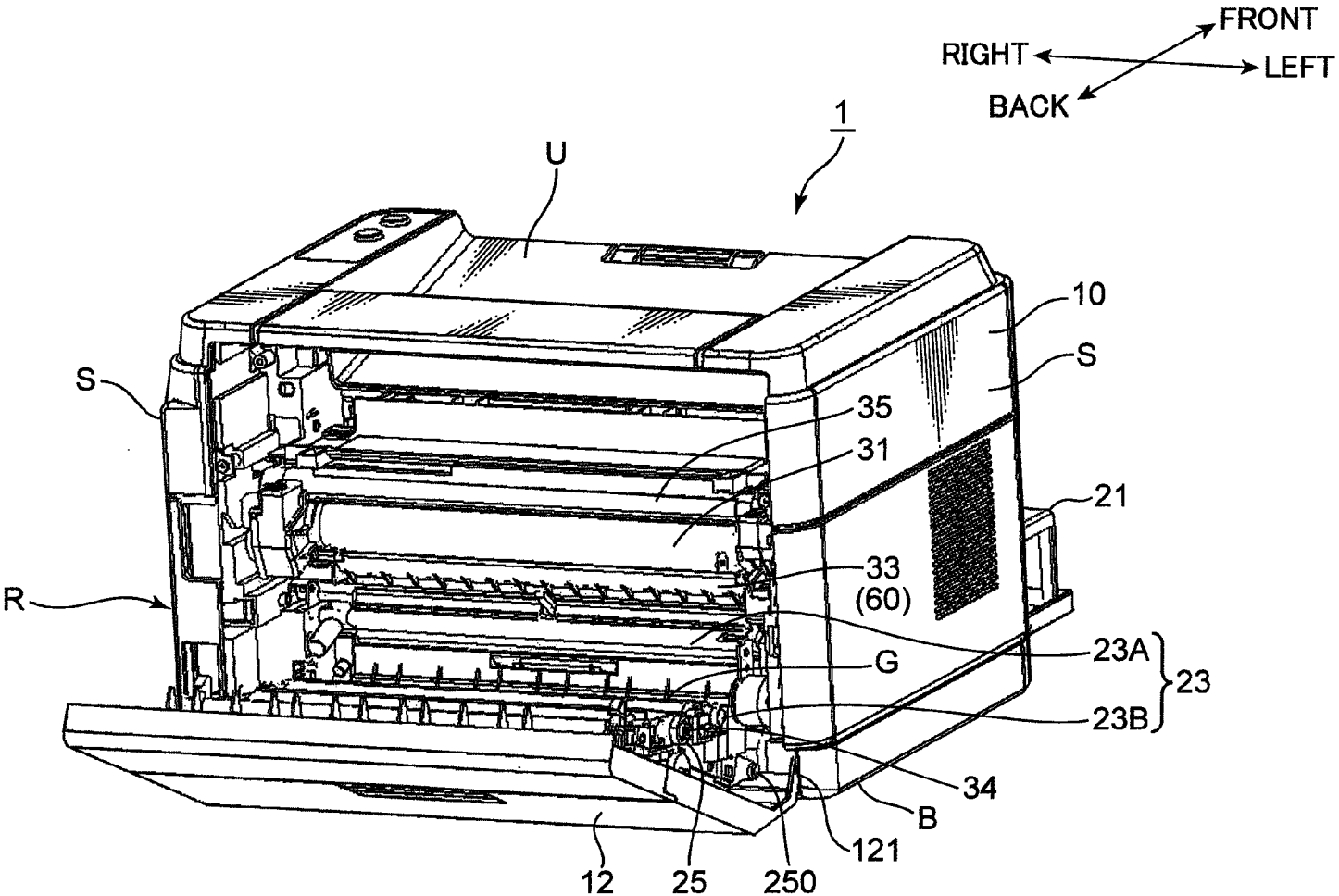
FIG. 7 is a perspective view showing an external appearance of the image forming apparatus in a state where a rear cover is open.

How to mount and remove the developing device 33 and the toner container 50 into and from the main housing 10 is described below. FIG. 7 is a perspective view showing an external appearance of the image forming apparatus 1 in a state where the rear cover 12 is open. In FIG. 7, denoted by U is the upper surface of the main housing 10. Further, denoted by S are the left and right side surfaces of the main housing 10, by R the rear surface thereof and by B the bottom surface thereof.

When the rear cover 12 on the rear surface R of the main housing 10 is rotated backward of the main housing 10 about the supporting point portion 121 and the reversing unit 25 is rotated backward of the main housing 10 about the supporting point portion 250, the interior of the main housing 10 is exposed. FIG. 7 shows a state where the interior of the main housing 10 is exposed. In this embodiment, a cover body as a combination of the rear cover (cover member) and the reversing unit 25 arranged at an inner side than the rear cover 12 in the main housing is equivalent to the "second cover".

If the interior of the main housing 10 is exposed, the cleaner 35, the photoconductive drum 31, the developer housing 60 of the developing device 33 and one roller 23A of the pair of registration rollers 23 are exposed. Note that the developing device 33 is so housed in the main housing 10 that the longitudinal direction of the developer housing 60 is a horizontal direction.

A conveyance guide surface G forming one surface of the main conveyance path 22F is provided on the surface (inner side surface) of the reversing unit 25 facing the interior of the main housing 10. As described above, the other roller 23B of the pair of registration rollers 23 and the transfer roller 34 are provided on the conveyance guide surface G. The reversing unit 25 rotates toward the interior of the image forming apparatus 1 about the supporting point portion 250, whereby the roller 23B and the transfer roller 34 respectively come into contact with the roller 23A and the photoconductive drum 31.

In the image forming apparatus 1 according to this embodiment, the user can pull out the developing device 33 from the main housing 10 or mount the developing device 33 into the main housing 10 with the rear cover 12 and the reversing unit 25 opened. That is, in mounting and removing the developing device 33 into and from the main housing 10, it is not necessary to mount and remove the toner container 50 and other members. In taking out the developing device 33 from the main housing 10, the user may open the rear cover 12 and the reversing unit 25 and pull out the developing device 33 from the main housing 10 with the developer housing 60 being kept in a horizontal posture. Further, in mounting the developing device 33, the user may insert the developing device 33 into the interior of the main housing 10 with the rear cover 12 and the reversing unit 25 opened with the developer housing 60 being kept in the horizontal posture.

By opening the rear cover 12 and the reversing unit 25, the main conveyance path 22F is opened. That is, a cover to be opened at the time of a jam clearing process and the like doubles as a cover to be opened at the time of mounting and removing the developing device 33. This contributes to a reduction in the number of covers provided on the main housing 10.

Figure 8:
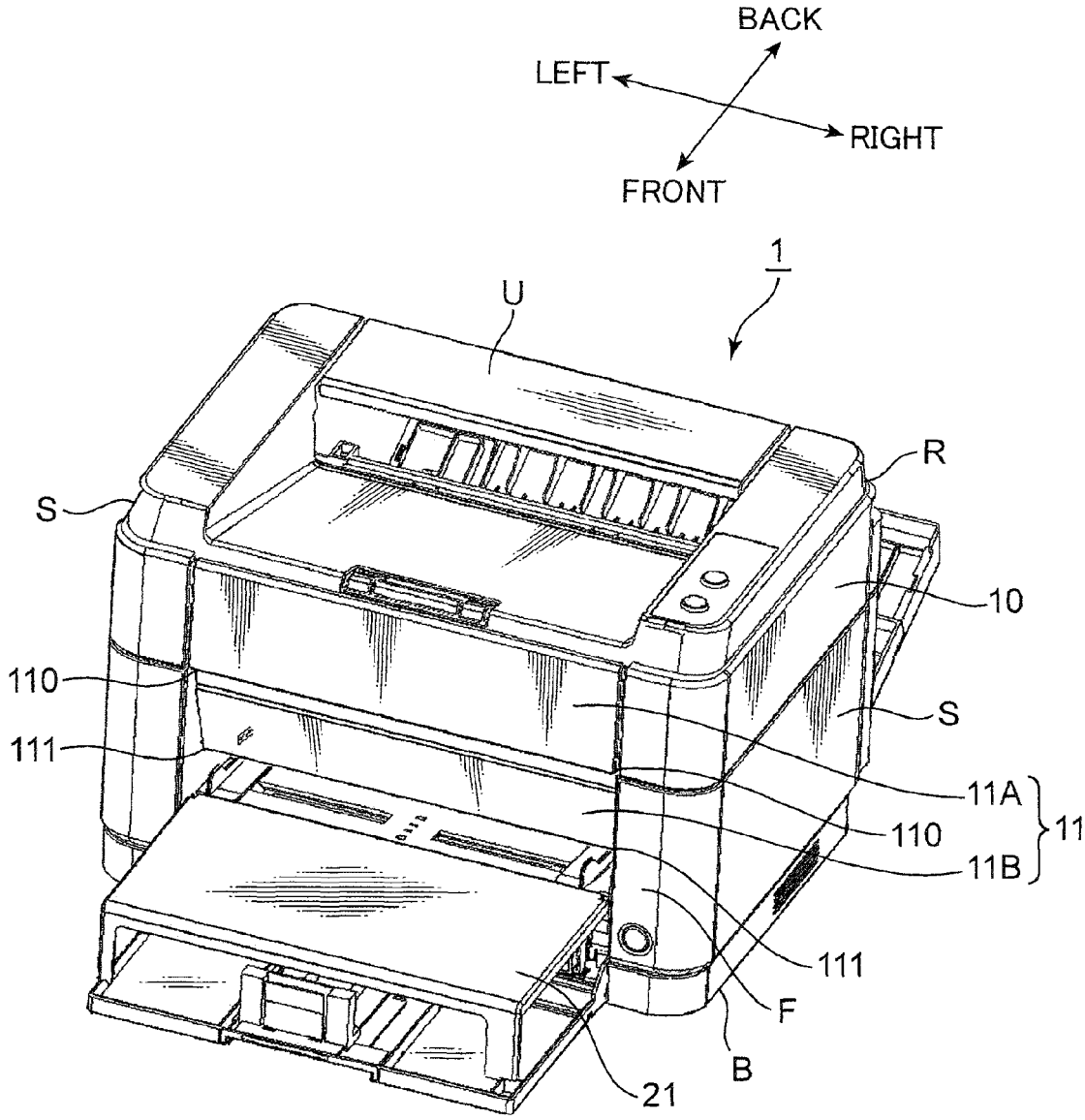
FIG. 8 is a perspective view showing an external appearance of the image forming apparatus in a state where a front cover is closed.
Figure 9:
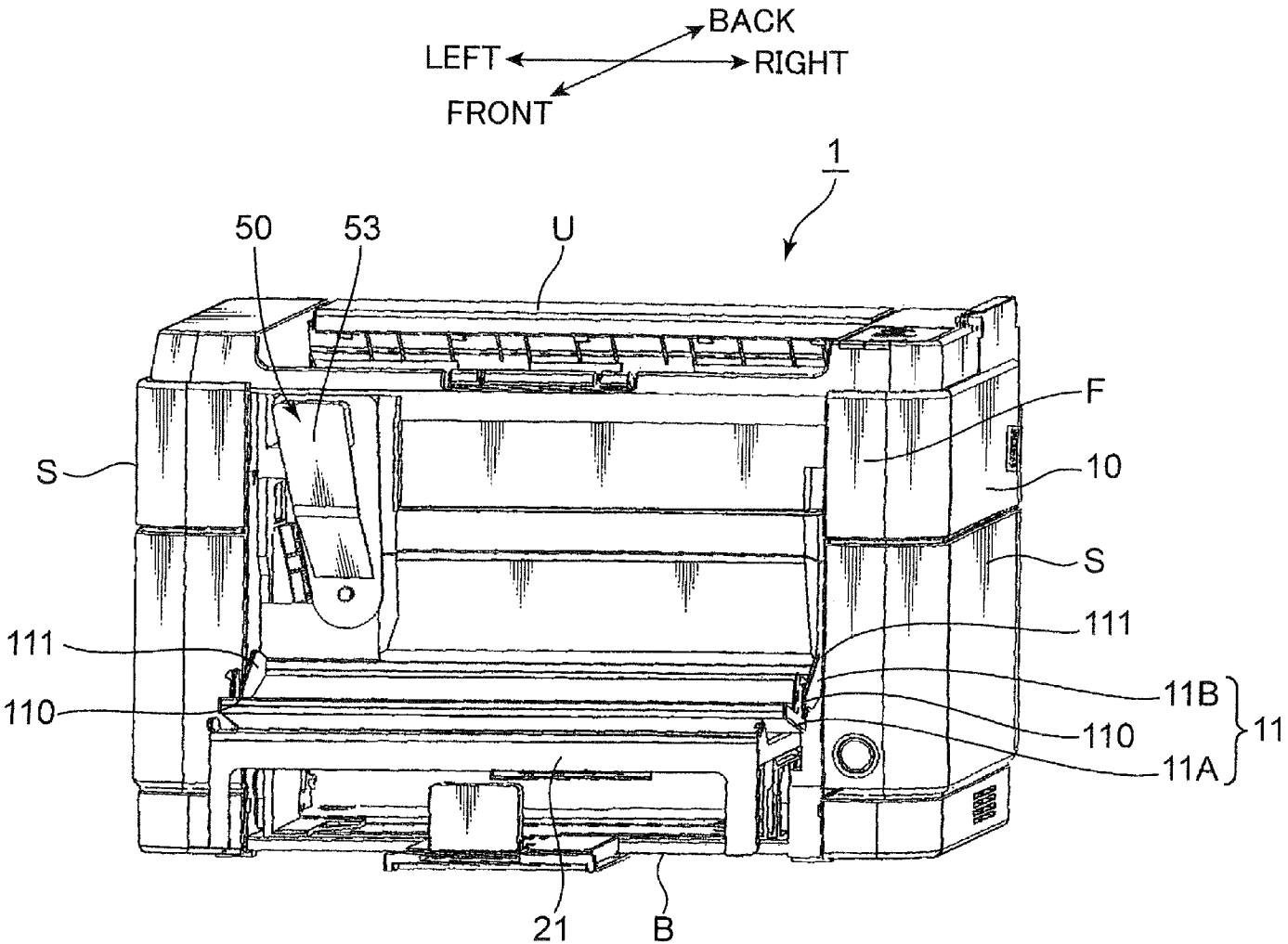
FIG. 9 is a perspective view showing an external appearance of the image forming apparatus in a state where the front cover is open.

FIG. 8 is a perspective view showing an external appearance of the image forming apparatus 1 in a state where the front cover 11 is closed. FIG. 9 is a perspective view showing an external appearance of the image forming apparatus in a state where the front cover 11 is open. The front cover 11 on the front surface F of the main housing 10 includes a first front cover 11A and a second front cover 11B below the first front cover 11A. The first front cover 11A is engaged with the second front cover 11B by a hinge engaging portion 110. The second front cover 11B is supported rotatably relative to the main housing 10 on a rotary shaft 111 below the hinge engaging portion 110.

The first front cover 11A and the second front cover 11B integrally rotate relative to the main housing 10 in such a state as to be bendable relative to each other at the hinge engaging portion 110. If the user pulls the first front cover 11A forward by gripping an upper part of the first front cover 11A, the front cover 11 is opened relative to the main housing 10. This state is shown in FIG. 9.

As shown in FIG. 9, the toner container 50 is exposed in the main housing 10 when the front cover 11 is open relative to the main housing 10. The toner container 50 is so assembled with the developing device 33 on the cylindrical portion 52 side as to be perpendicular to the longitudinal direction of the developer housing 60 of the developing device 33. Thus, the lid member 53 of the toner container 50 faces in a direction toward the front surface of the main housing 10, wherefore the lid member 53 side is exposed.

In the image forming apparatus 1 according to this embodiment, the user can pull the toner container 50 alone from the main housing 10 or mount it into the main housing 10 with the front cover 11 opened. That is, it is not necessary to mount and remove the developing device 33 and other members in mounting and removing the toner container 50 into and from the main housing 10. In taking out the toner container 50 from the main housing 10, the user may open only the front cover 11 and pull out only the toner container 50 from the front side of the main housing 10 by holding the lid member 53 of the toner container 50.

Also in the case of mounting the toner container 50 into the main housing 10, the front cover 11 may be opened and the toner container 50 may be inserted to a predetermined position. Note that the toner container 50 is mounted and removed at the side of the front cover 11 because the toner container 50 is more frequently exchanged than the developing device 33 and it is desirable for the user to mount and remove the toner container 50 at the easily accessible front cover 11 side.

As shown in FIG. 7, the developing device 33 is so housed in the main housing 10 that the longitudinal direction of the developer housing 60 is aligned with the lateral direction. On the other hand, in mounting the toner container 50, the user inserts the toner container 50 backward into the main housing 10 by holding the lid member 53 of the toner container 50. When the toner container 50 is inserted to the predetermined position where the toner supply opening 60H of the developer housing 60 and the toner discharge opening 521 of the cylindrical portion 52 overlap in the vertical direction, the assembling of the toner container 50 with the developing device 33 is completed.

In this embodiment, the toner container 50 is mounted in a mounting direction (direction along the axial direction of the rotating member 54) perpendicular to the longitudinal direction of the developer housing 60 (axial direction of the developing roller 331). This contributes to enabling the developing device 33 and the toner container 50 to be taken out through the surfaces of the main housing 10 different from each other.

If the longitudinal direction of the developer housing 60 and the mounting direction of the toner container 50 should be the same, the toner container 50 is slid and mounted along the ceiling surface of the developer housing 60. In such a mounting mode, a mounting order of the toner container 50 and the developing device 33 is automatically determined. That is, unless the developing device 33 is mounted in the main housing 10, the toner container 50 cannot be mounted. Further, unless the toner container 50 is removed, the developing device cannot be removed from the main housing 10. Thus, it becomes less significant to take out the both through the mutually different surfaces of the main housing 10.

Although one embodiment of the present disclosure has been described above, the present disclosure is not limited to this. For example, in the above embodiment, the developing device is exposed with the longitudinal direction of the developer housing 60 aligned with the lateral direction when the rear cover 12 and the reversing unit 25 are opened, and the lid member 53 of the toner container 50 is exposed when the front cover 11 is opened. Instead of this, the toner container 50 may be assembled with the developing device 33 from above, and a cover used to take out the toner container 50 may be provided on the upper surface U (first surface) of the image forming apparatus 1. Further, a cover used to take out the developing device 33 may be provided on the side surface S (second surface) of the image forming apparatus 1.

The cover body as a combination of the rear cover 12 and the reversing unit 25 has been illustrated as an example of the "second cover". The second cover may be a simple cover body provided with a conveyance guide surface on one surface thereof.

As described above, according to the image forming apparatus 1 of this embodiment, the main housing 10 is provided with the front cover 11 used to take out the toner container 50 to the outside and the rear cover 12 used to take out the developing device 33 to the outside.

This enables the developing device 33 and the toner container 50 to be respectively exchanged by opening the covers on the different surfaces. Accordingly, in exchanging one of the developing device 33 and the toner container 50, it is possible to reduce a possibility of erroneously exchanging the other.

Further, since the toner container 50 can be taken out by opening the front cover 11 and the reversing unit 25, the toner container 50 can be exchanged without taking out the developing device 33. This can prevent the developing device 33 from being damaged unlike the case where the developing device 33 is also taken out in exchanging the toner container 50.

Furthermore, in the main housing 10, the front cover 11 is provided on the front surface F and the rear cover 12 is provided on the rear surface R. That is, the toner container 50 and the developing device 33 are respectively mounted and removed through the surfaces facing each other. Thus, a degree of freedom in the installation location of the image forming apparatus 1 is increased unlike the case where covers are provided on the front, both side and rear surfaces of the main housing 10.

Furthermore, the conveyance guide surface G forming the one surface of the main conveyance path 22F is exposed when the rear cover 12 and the reversing unit 25 are opened. That is, since the cover to be opened at the time of a jam processing and the like doubles as the cover to be opened at the time of mounting and removing the developing device 33, the number of covers provided on the main housing 10 can be reduced.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

an image bearing member for bearing a toner image on a circumferential surface;

a developing device including a developing roller for supplying toner to the circumferential surface of the image bearing member;

a toner container to be assembled with the developing device to supply the toner to the developing device;

a sheet conveyance path for conveying a sheet; and a housing for accommodating the image bearing member, the developing device and the toner container; wherein:

the toner container includes a container main body for storing the toner, a cylindrical portion projecting from the container main body, a toner discharge opening provided on the cylindrical portion, a rotating member to convey the toner housed in the toner container to the toner discharge opening, a part of the rotating member is housed in the cylindrical portion, and a container gear is arranged on a leading end of the cylindrical portion;

the developing device includes a developer housing, a toner supply opening provided on the developer housing and receiving the toner form the toner discharge opening, and a gear holder engaged with the container gear for transmitting a rotational drive force to the rotating member, the developer housing is long in a first direction along an axial direction of the developing roller;

the housing has a first surface and a second surface facing the first surface;

the toner container is assembled with the developing device along a second direction perpendicular to the first direction and is taken out from the interior of the housing to the outside of the housing through the first surface; and the developing device is taken out from the interior of the housing to the outside of the housing through the second surface.

2. An image forming apparatus according to claim 1, further comprising:

a first cover which is provided on the first surface and opened in taking out the toner container from the interior of the housing to the outside of the housing; and a second cover which is provided on the second surface and opened in taking out the developing device from the interior of the housing to the outside of the housing, the second cover including a conveyance guide surface which forms one surface of the sheet conveyance path.

3. An image forming apparatus according to claim 1, wherein:

the housing has a front surface to which a user will face, a rear surface opposite to the front surface, side surfaces, an upper surface and a bottom surface;

the first surface is arranged on the front surface; and the second surface is arranged on the rear surface.

4. An image forming apparatus according to claim 1, wherein:

the developing device includes a shutter plate which is slid between a state where the toner supply opening is closed and a state where the toner supply opening is open, and a biasing spring which biases the shutter plate in a direction to close the toner supply opening;

the toner container includes a pressing plate arranged near the toner discharge opening;

the pressing plate presses the shutter plate to open the toner supply opening, and the toner supply opening and the toner discharge opening overlap in a vertical direction with the toner container assembled with the developing device; and the shutter plate is released from the pressing by the pressing plate when the toner container is removed from the housing or when the developing device is removed from the housing.

5. An image forming apparatus according to claim 2, wherein:

the sheet conveyance path includes a main conveyance path used in printing one side of a sheet and a reversing conveyance path used in printing both sides of a sheet;

the second cover includes a cover member which is rotatably mounted on the housing and opens the second surface, and a reversing unit which is rotatably mounted on the housing at an inner side than the cover member in the housing and forms one conveyance guide surface of each of the main conveyance path and the reversing conveyance path; and the main conveyance path is opened by opening the cover member and the reversing unit relative to the housing.

* * * * *